United States Patent [19]

Buenos et al.

[11] Patent Number: 4,944,041

[45] Date of Patent: Jul. 31, 1990

[54] CUFF CONSTRUCTIONS

[76] Inventors: Anne M. Buenos, 424 Habersham St., Savannah, Ga. 31401; Jane M. Buenos, 425 Riverside Dr., New York, N.Y. 10025; Leroy M. Sylverst, 910 Riverside Dr., Apt. 4G, New York, N.Y. 10032

[21] Appl. No.: 211,009

[22] Filed: Jun. 24, 1988

Related U.S. Application Data

[62] Division of Ser. No. 860,403, May 7, 1986, Pat. No. 4,756,027.

[51] Int. Cl.[5] ..... A41D 27/18

[52] U.S. Cl. ..... 2/84; 2/98

[58] Field of Search ..... 2/270, 202, 206, 208, 2/158, 159, 123, 124, 84, 88, 98

[56] References Cited

U.S. PATENT DOCUMENTS

| | | |
|---|---|---|
| Re.7,759 | 6/1877 | Silva . |
| 19,049 | 9/1805 | Reichenfeld . |
| 338,790 | 3/1886 | Slack . |
| 350,851 | 6/1891 | Langer . |
| 651,701 | 1/1900 | Delamere . |
| 1,033,047 | 7/1912 | Cabelinsky . |
| 1,296,966 | 3/1919 | Kaufman . |
| 1,680,592 | 5/1927 | Chiles . |
| 2,315,889 | 7/1942 | Wells . |
| 2,323,136 | 11/1941 | Johanson . |
| 2,655,660 | 7/1948 | Racz . |
| 2,836,828 | 1/1956 | Henrikson . |
| 3,416,518 | 9/1966 | Samuels . |
| 4,297,746 | 11/1981 | Zarbos . |
| 4,329,742 | 5/1982 | Schuessler . |
| 4,359,784 | 11/1982 | Harrington . |
| 4,543,670 | 10/1985 | Ehring . |
| 4,559,647 | 12/1985 | Smith . |

OTHER PUBLICATIONS

Velcro Digest, Jornal of A.M.A., vol. 168, No. 7, Oct. 19, 1958.

*Primary Examiner*—H. Hampton Hunter

[57] ABSTRACT

A cuff construction having readily accessible coverings for hands, feet and head is provided. The cuff is generally integrally attached to an article of clothing, and folds in on itself for storing the coverings. The cuff is formed at an opening in a garment, such as a glove, sleeve, neck or leg and included a panel along about one half of the circumference of the opening with the two adjacent edges of the panel secured to the cuff. The panel is switchable between a first open positon allowing the head, hand or foot to pass through and a second closed position forming a covering around the appendage. The covering may take the form of a glove or mitten, a sock or shoe, or a ski mask or the like. A pocket for ready storage may also be provided.

10 Claims, 5 Drawing Sheets

FIG. 1
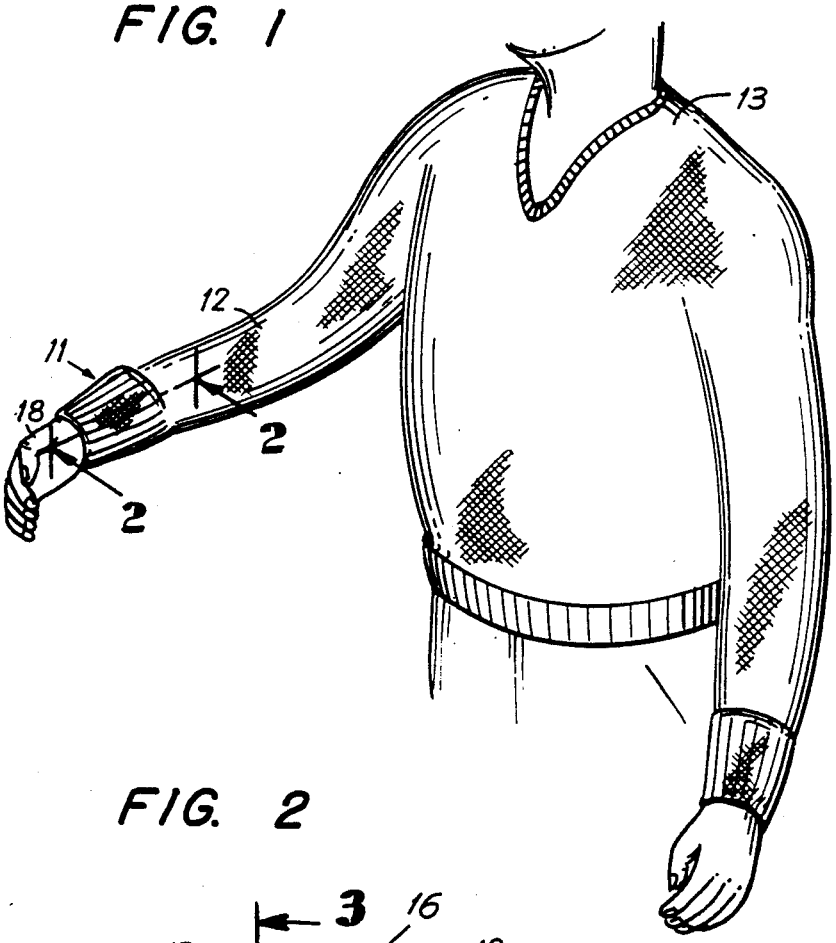
FIG. 2
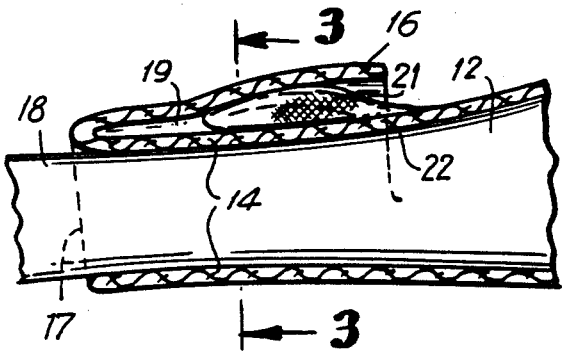
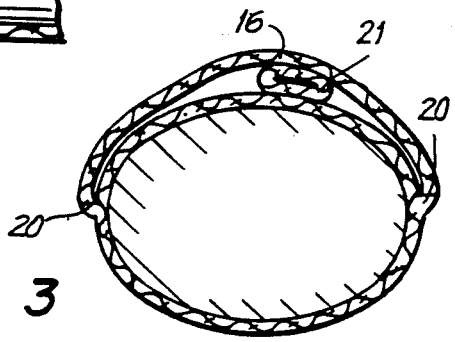
FIG. 3

FIG. 4
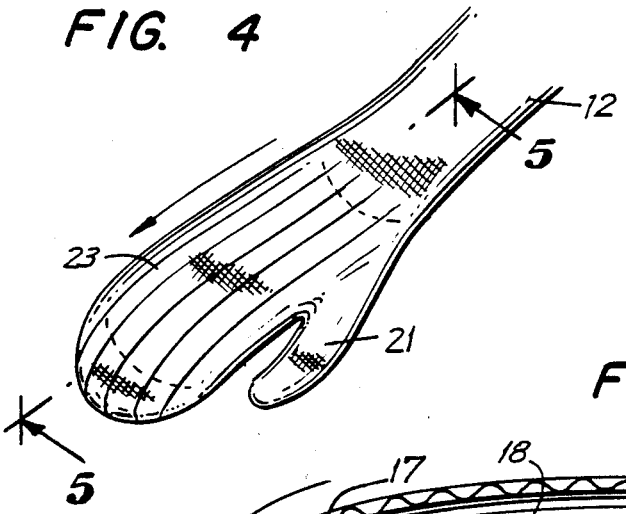
FIG. 5
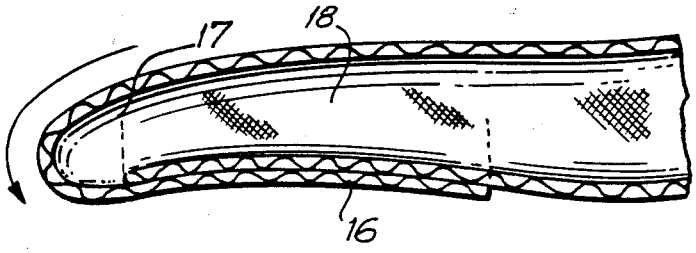
FIG. 8
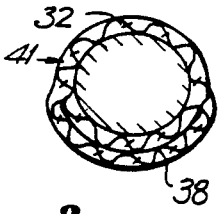
FIG. 6
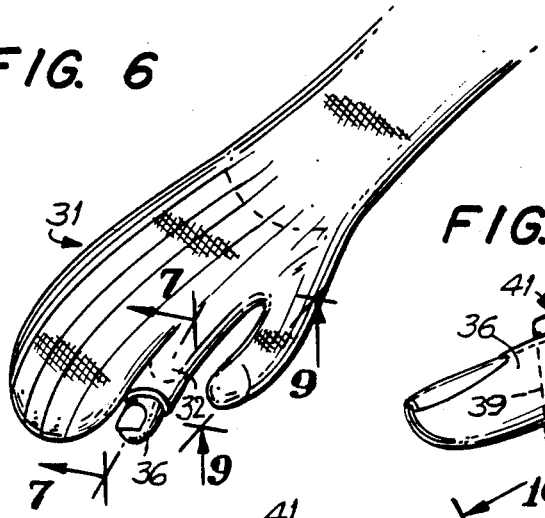
FIG. 7
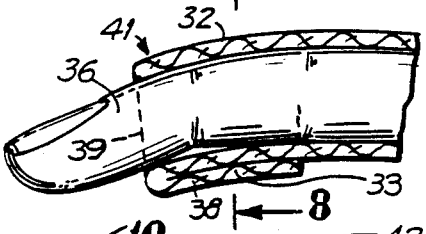
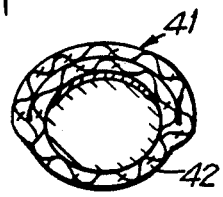
FIG. 10
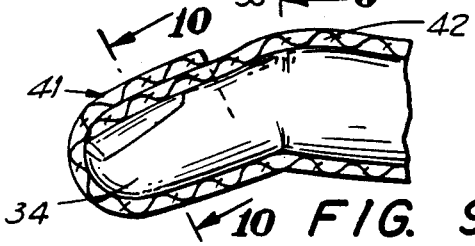
FIG. 9

FIG. 11
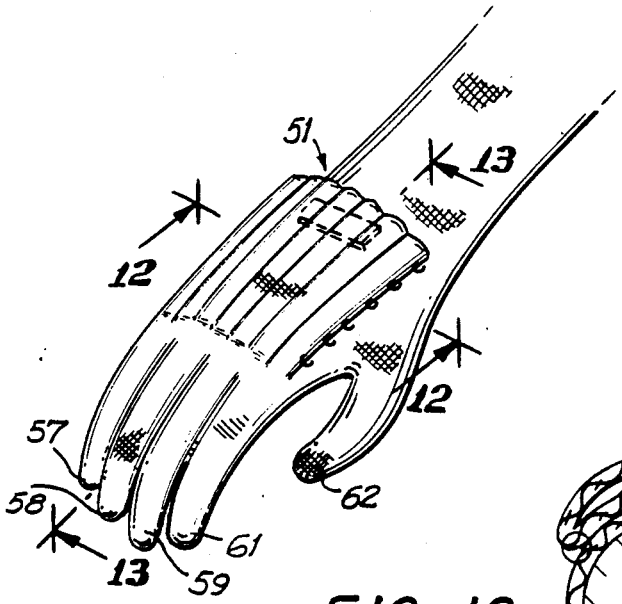
FIG. 14
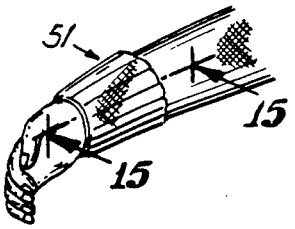
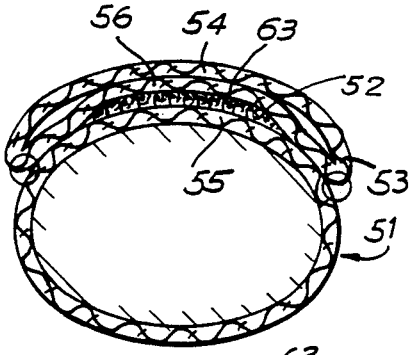
FIG. 12
FIG. 15
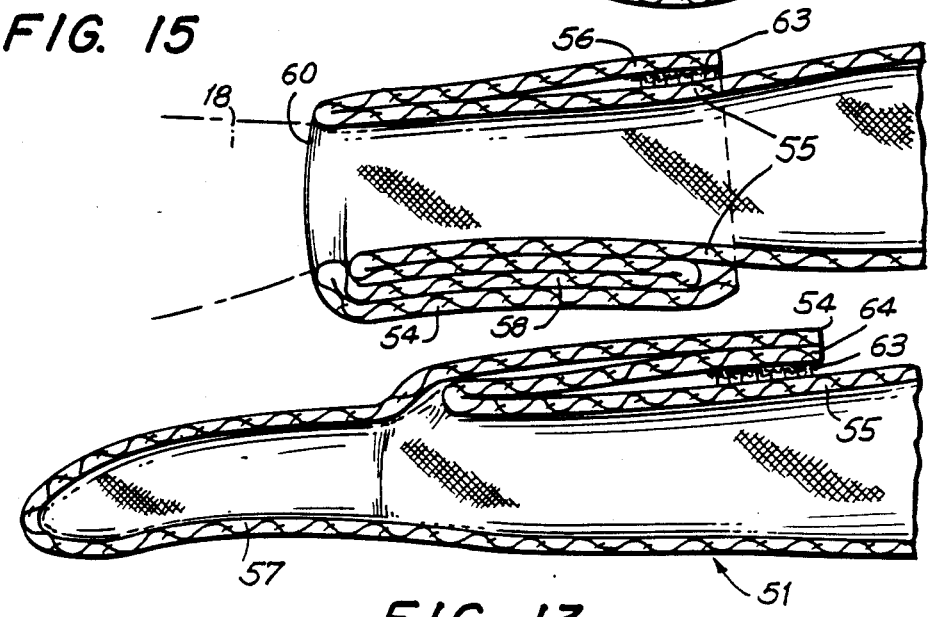
FIG. 13

FIG. 16
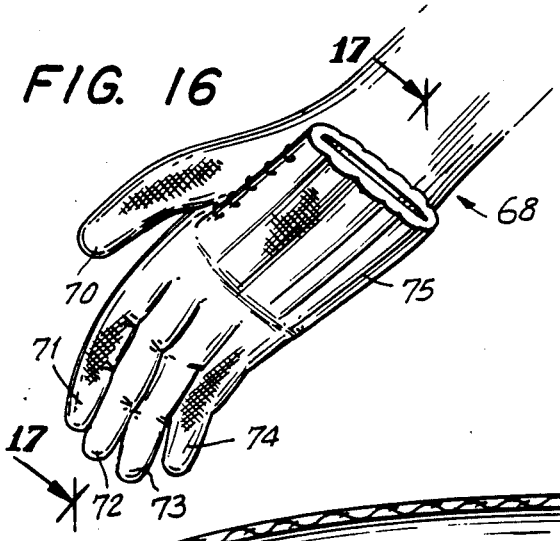
FIG. 17
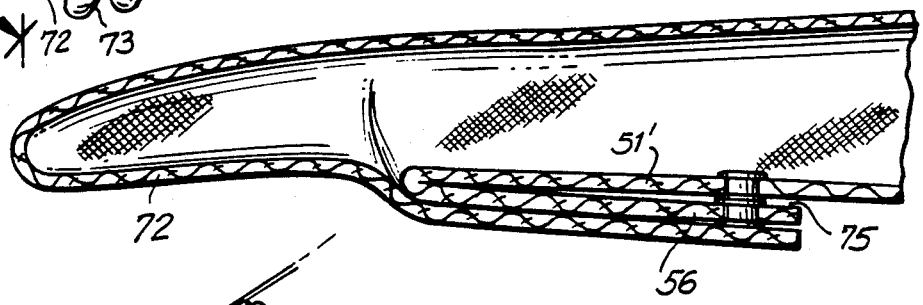
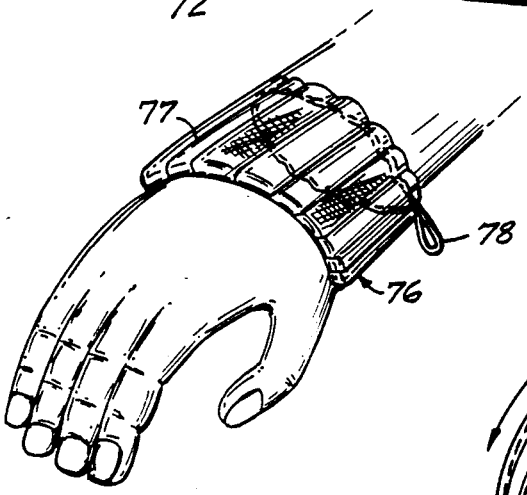
FIG. 18
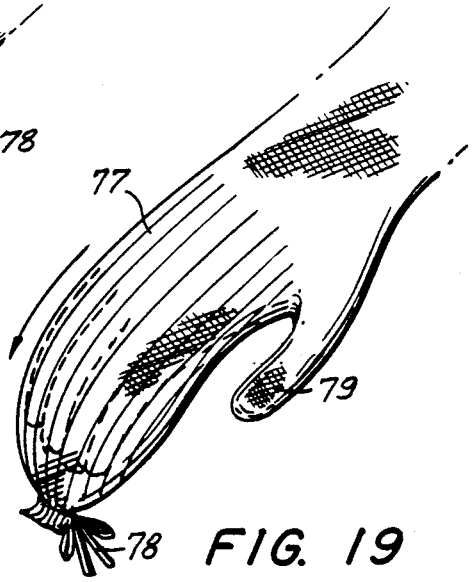
FIG. 19

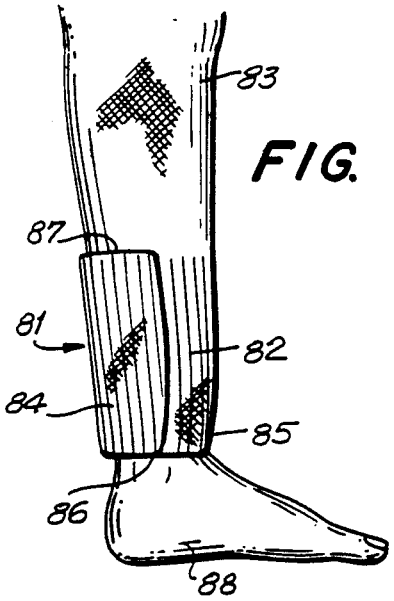
FIG. 20
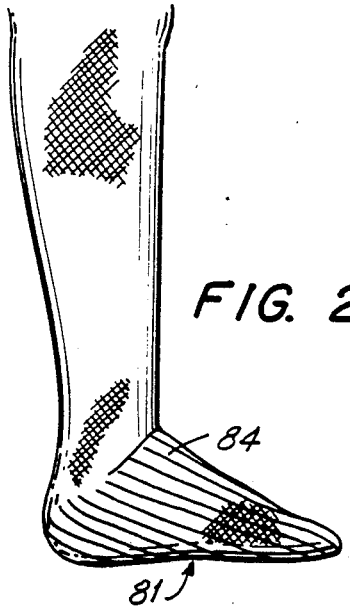
FIG. 21
FIG. 22
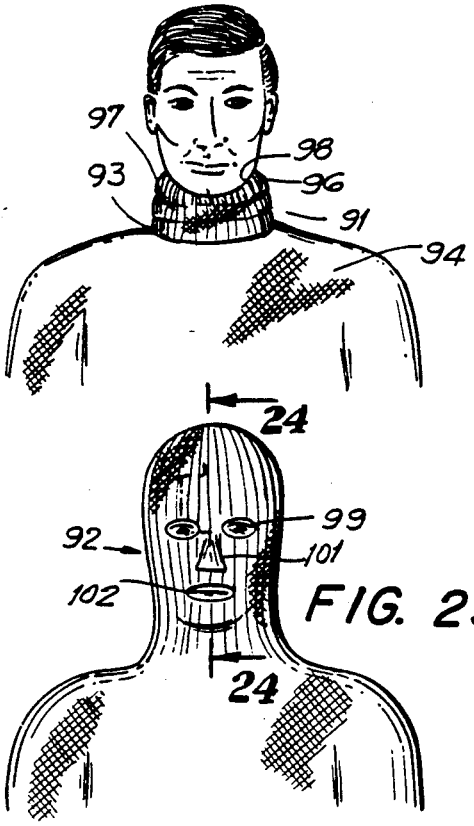
FIG. 23
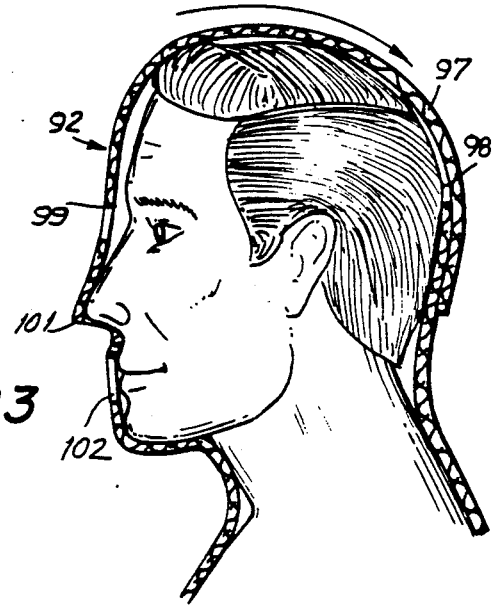
FIG. 24

CUFF CONSTRUCTIONS

This is a division of application Ser. No. 860,403, filed May 7, 1986, now U.S. Pat. No. 4,756,027 dated July 12, 1988.

BACKGROUND OF THE INVENTION

This invention relates in general to cuff constructions, and in particular to cuff constructions for garments and the like which provide covering for hands, feet or head and are integrally formed with the cuff.

Cuffs are well known in the art of clothing manufacture. Almost every article of clothing has a cuff of some sort at the opening through which a person's limb is extended. These cuffs come in many forms, such as button closing cuffs and elastic band closing cuffs, but the main function of these cuffs is merely to seal the clothing around the limb or neck of the wearer.

These conventional cuffs have been satisfactory for some time; however, they can be improved to provide additional benefits other than merely sealing about an opening or providing a decorative feature. It would be further advantageous if a cuff provided a covering for hands, feet and head which is easily accessible and does not get lost. The covering is generally a separate distinct piece from the cuff and the article of clothing to which the cuff is integral. Therefore, the gloves or socks have to be removed and stored in a secure place and then retrieved from that place and put back on to the hand or foot each time the wearer of the covering wished to switch from covered use to bare use and vice versa. The same is true for a hat or mask which a wearer would use at certain times. If the period of time of use between bare and covered use is not of short duration it then becomes necessary to keep track of where the coverings were stored so that they will not be lost or mislaid.

Accordingly, it is desirable to provide a cuff construction which provides the additional function of providing hand, foot or head coverings integral with the cuff so that the covering is always within easy reach, while also keeping them in a convenient storage spot out of the way when not in use.

SUMMARY OF THE INVENTION

Generally speaking, in accordance with the invention, a cuff having an improved construction for providing a readily accessible covering for hands, feet and head is provided. The cuff construction includes a panel secured to the distal end of the cuff and extending about substantially one half the circumference for forming a pocket. The panel is switchable from a first open position to a second closed position. In the first open position, the panel is folded back forming an opening through which the wearer's hand, foot or head extends. In the second closed, or in use position, the panel is folded over away from the cuff, closing the opening and revealing a closed area for forming a cover. In the case of a hand covering a thumb may be included to provide a mitten or additional fingers to provide a glove. This closed area may consist of either the fingers of a glove or a mitten, a sock or slipper, or a hat depending upon which appendage is being covered.

Accordingly, it is an object of the invention to provide an improved cuff construction.

It is another object of the invention to provide an improved appendage or head covering.

It is another object of the invention to provide an improved covering for hands, feet or head.

It is a further object of the invention to provide a cuff construction which includes a covering for hands, feet or head which is an integral part of the cuff.

Still another object of the invention is to provide a garment including an improved cuff construction which includes a covering for hands, feet and head.

Still a further object of the invention is to provide a garment construction including a covering for hands, feet or head which is stored in the cuff of the garment.

Yet another object of the invention is to provide a garment construction in which a hand, foot or head covering is integrally formed with the garment cuffs.

Still other objects and advantages of the invention will in part be obvious and will in part be apparent from the specification and drawings.

The invention accordingly comprises features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a sweater-type garment including a cuff construction in accordance with the invention in an open position;

FIG. 2 is a cross-sectional view of the cuff of FIG. 1 taken along line 2—2;

FIG. 3 is a cross-sectional view of the cuff of FIGS. 1 and 2 taken along line 3—3 of FIG. 2;

FIG. 4 is a perspective view of the cuff in a position with the covering;

FIG. 5 is a cross-sectional view of the cuff construction taken along line 5—5 of FIG. 4;

FIG. 6 is a perspective view of an alternate embodiment of the cuff construction showing a hunter's mitten with forefinger exposed and thumb;

FIG. 7 is a cross-sectional view of the embodiment of FIG. 6 taken along line 7—7;

FIG. 8 is a cross-sectional view of the of the embodiment of FIG. 7 taken along line 8—8;

FIG. 9 is a cross-sectional view of the of the embodiment of FIG. 6 in the closed position taken along line 9—9;

FIG. 10 is a cross-sectional view of the embodiment of FIG. 6 taken along line 10—10 of FIG. 9;

FIG. 11 is a perspective view of another embodiment of the cuff construction in the closed position;

FIG. 12 is a cross-sectional view of the embodiment of FIG. 11 taken along line 12—12;

FIG. 13 is a cross-sectional view of the embodiment of FIG. 11 taken along line 13—13;

FIG. 14 is a perspective view of the embodiment of FIG. 11 shown in the open position;

FIG. 15 is a cross-sectional view of the embodiment of FIG. 14 taken along line 15—15;

FIG. 16 is a perspective view of a glove embodiment with a pocket in the palm;

FIG. 17 is a cross-sectional view of the embodiment of FIG. 16 taken along line 17—17;

FIG. 18 is a perspective view of another alternate embodiment in the open position;

FIG. 19 is a perspective view of the embodiment of FIG. 18 in the closed position;

FIG. 20 is an elevational view of a cuff construction for use as a foot convering in an open position; in accordance with the invention:

FIG. 21 is an elevational view of the cuff construction of FIG. 20 in a closed position;

FIGS. 22 and 23 are elevational views of a cuff construction embodied in a collar for forming a mask in open and closed positions, respectively; and FIG. 24 is a cross-sectional view of the embodiment of FIG. 23 taken along line 24—24.

DETAILED DESCRIPTION OF THE PREFERRED EMBODIMENTS

Reference is made to FIGS. 1, 2, and 3, wherein a cuff construction arranged in accordance with the invention is shown as part of a garment. A cuff generally indicated as 11, is integrally formed at the end of sleeves 12 of an article of clothing, such as a sweater 13. Cuff 11 consists of a distal portion 14 of sleeve 12 and a folding panel 16 which is folded back over sleeve distal portion 14 and forms sleeve opening 17. As shown more clearly in FIGS. 2 and 3, when folding panel 16 is shown in its open position as shown in FIGS. 1-3, a wearer's hand 18 may pass through opening 17.

Panel 16 extends substantially half-way around the circumference of cuff 11 and is secured at its side 20 to cuff 11. In this manner panel 16 in the folded back position forms a pocket 19 in that panel 16 is closed at its far end and attached to sleeve distal portion 14. A thumb 21 is integrally formed as part of cuff 11 and is folded into pocket 19 when panel 16 is in the up or open position. Thumb 21 communicates with the inside of cuff 11 by means of a hole 22 located at the base of thumb 21. In this position, with panel 16 folded back along cuff 11 in the open position, user's hand 18 slides through hole 17 and thumb 21 is tucked away in pocket 19 formed by panel 16. Thus, the general appearance of cuff 11 is that of a regular cuff of sweater 13 or other garment.

FIGS. 4 and 5 show cuff 11 in the closed position to form a hand covering or mitten 23. Panel 16 is pulled down and around the front of wearer's hand 18 and over the opposite portion of the distal portion 14 of sleeve 12. This is done by turning the closed end of pocket 19 inside out. This exposes thumb 21 and closes sleeve opening 17. The overall effect is that mitten 23 is formed at the end of each sleeve 12. User's hand 18 fits into mitten 23 of the cuff construction as it would into a normal mitten. Panel 16 is now at the opposite side of cuff 11 from where it was situated in the open position.

To reform cuff 11 into a standard cuff, the above described process of folding folding panel 16 is merely reversed.

While in this embodiment the garment is a sweater, it is within the scope of the invention to utilize-the cuff construction on a wide variety of garments. Sweater 13 may be of a conventional wool or acrylic material or the like. If the garment is a shirt or jacket, it may be constructed of natural fiber, such as cotton, or synthetic materials, such as nylon or polyester. The advantages and conveniences provided by the cuff construction make it particularly useful for a wide variety of uses. For example, a child's or infant's sweater fabricated with the cuff construction can instantly provide a hand covering to keep the wearer's hand warm. Similarly, a hunter or hiker suddenly overcome by a cold wind can instantly cover their hands. In all cases, the covering is part of the garment so that there is no need to stop one's activity and search for mittens or gloves. This convenience will also make it advantageous for use of the cuff constructions in areas such as space flights. In this latter case, the garment and/or cuff may be formed of an airtight material and, when in the closed position, folding panel 16 will be sealed to distal portion 14 of sleeve 12.

Reference is now made to FIGS. 6-10, wherein an alternate embodiment of a hunter's mitten shown generally as 31 is depicted. Specifically, a second finger, namely, the forefinger, is added to the mitten construction. When the cuff construction is in the open position, a forefinger cover 32 also folds into a pocket 33. Forefinger cover 32 communicates with the inner space of the cuff through a hole (not shown) in the same manner as hole 22 in the embodiment of FIGS. 1-5. Hunter's glove 31 allows for increased dexterity by allowing use of a thumb 34 with a forefinger 36. This embodiment provides all the advantages of the first embodiment and further provides increased dexterity by providing at least two fingers in the hand coverings. For even further increased dexterity and the use of tactile senses, forefinger 36 and thumb 34 can be exposed in the same manner as user's hand 18 is exposed in the above description of cuff 11.

A finger covering 37, formed with a distal end 41, a panel 38 is attached in the same way as panel 16 was attached to cuff 11. In the open position, forefinger 36 extends through finger covering 37 through an opening 39 at distal end 41 of finger cover 37. To close opening 39, panel 38 is pulled up and over the exposed part of forefinger 36 in a fashion similar to that shown in FIG. 9. The same process applies to thumb 34 having a thumb covering 42. A panel 41 is affixed to thumb covering 42 in the same manner as described above. To open thumb covering 42 and expose thumb 36, panel 43 is pulled out and over the thumb 36 and folded back in the now familiar manner. To reclose thumb covering 42, the process is reversed and panel 43 is folded over thumb 34.

Reference is now made to FIGS. 11-15, wherein a further embodiment of the invention with the hand covering forming a full glove with each finger having its own separate covering is shown generally as 51. A storage compartment 52 is formed above the hand portion by a flattened loop 53 having an upper portion 54 and a lower portion 56. In this embodiment, upper half 54 serves as the panel for closing the cuff and forming the pocket for storage of the finger coverings when in the open position.

In the closed position, as depicted in FIG. 11, each of a user's fingers is enclosed in a respective pinkie covering 57, ring finger covering 58, middle finger covering 59, forefinger covering 61 and thumb covering 62, respectively.

Loop 53 is attached to the distal end of cuff 51 at lower portion 56. In the illustrated embodiment lower portion 56 is sewn to a surface 55 of cuff 51 in the region of the back of the wearer's hand along the two edges adjacent to the fold. The opposite edge 64 is formed with a fastener of Velcro 63 for forming storage compartment 52. Any fastening means, such as buttons, snaps, or the like, may be substituted. Additionally, this embodiment of a full five finger glove may be constructed without loop 53 so that a pocket is formed only from panel 54 as in the earlier embodiments and the back surface of cuff 51.

Cuff 51 may be turned into its open position as shown in FIG. 14 by turning panel 54 up and over all the finger coverings. This forms an opening 50 allowing the passage of an uncovered user's hand 18 therethrough. Panel 54 is now positioned on the side of cuff 51 opposite from where it was situated in the closed position. As lower portion 56 of loop 53 is fixed to the surface of cuff 51, it remains in place. The overall effect is to form a normal looking cuff at the end of a sleeve as shown in FIG. 14. Similar to the previously described embodiment, finger coverings 57, 58, 59, 61 and 62 are stored between panel 54 and the outer surface of cuff 51. Cuff construction 51 may be returned to the closed position by reversing the above described process. Namely, pulling panel 54 over hand 18 closing opening 60.

Reference is now made to FIGS. 16 and 17, wherein another embodiment of a cuff construction including a full glove 68 is shown. Glove 68 includes a panel 69 shown in the closed position in FIG. 16 with finger coverings 70, 71, 72, 73 and 74. In this state, a pocket 75 formed between lower portion 56' and the palm surface of cuff 51' below a wearer's hand. The operation for switching from open to closed positions and the storage of fingers 70, 71, 72, 73 and 74 during the open position use is the same as the previously described embodiments.

In FIGS. 18 and 19 another alternate embodiment of the cuff construction forming a mitten 76 in accordance with the invention is shown. In FIG. 18 a cuff 77 is shown in the open position with a drawstring 78 about the edge of cuff 77. Cuff 77 may easily be placed into the closed position to expose a thumb covering 79 which communicates into cuff 77. Mitten 76 is formed by pulling drawstring 78 to close the end of the unfolded cuff 77. When cuff 77 is in the open position, thumb covering 79 is tucked away within cuff 77 and the general appearance of cuff 77 is that of a regular cuff.

FIGS. 20 and 21 illustrate a further embodiment in accordance with the invention wherein the cuff construction is utilized in a foot covering 81. A cuff 82 is integrally formed at the end of leg 83 of an article of clothing such as a pair of pants. Cuff 82 has a distal portion 85, a folding panel 84 which is folded back over leg 83 and forms an opening 86. When folding panel 84 is in its open position as shown in FIG. 20, a wearer's foot 88 may pass through opening 86.

Panel 84 extends substantially half way around circumference of cuff 82 and forms a pocket 87. In this position, with folding panel 84 folded back along cuff 82 in the open position, a user's foot 88 slides through opening 86. Also, in this position, the general appearance of cuff 82 is that of a regular cuff of a pant leg, or other similar garment.

FIG. 21 illustrates cuff 82 in the closed position to form a foot covering. Panel 84 is pulled down and around the heel of a wearer's foot 88. This is done by turning the closed end of pocket 87 inside out. The overall effect is that a sock-like covering 81 is formed at the end of leg 83. A user's foot 88 fits into covering 81 of cuff construction 82 as it would into a sock or shoe. Panel 84 is now above the wearer's foot in a relatively opposite position in relation to the cuff from where it was situated in the open position.

To reform cuff 82 into a standard cuff, the above described process of folding panel 84 is merely reversed.

FIGS. 22–24 illustrate yet another embodiment in accordance with the invention wherein a cuff or neck 91 converts to a face mask 92. Cuff 91 is integrally formed at the top end of a collar 93 of an article of clothing, such as a sweater 94. Cuff 91 includes a distal portion 96 and a folding panel 97 which is folded back over collar distal portion 93 and forms collar opening 98. When panel 97 is in its open position as shown in FIG. 22, a wearer's head passes through opening 98.

Panel 97 extends substantially halfway around the circumference of distal portion 96 and is secured at its sides to collar 93. Therefore, panel 97 in the folded back position forms a pocket with a downwardly facing open pocket when worn in the same manner as the earlier described embodiments. Openings for eyes, nose and mouth are provided on collar 93 and are covered by folded panel 97 in the open position. With panel 97 folded back and in the open position, a wearer's head fits through neck opening 98, and a pair of eye openings 99, a nose opening 101 and a mouth opening 102 are tucked away in the pocket formed by panel 97. In this position, the general appearance of cuff 91 is that of a regular collar of sweater 94 or other garment.

FIG. 23 shows cuff 91 in the closed position to form the face mask type of covering. Panel 97 is shown pulled up and around the front of wearer's head and over the opposite portion of the distal portion of collar 93. This is done by opening the closed end of the pocket inside out. This exposes eye opening 99, nose opening 101 and mouth opening 102. The overall effect is that a face mask is formed at the end of collar 93, with the appropriate openings aligning themselves with the user's face to allow seeing and breathing. Panel 97 is now positioned above the wearer's head and closes opening 98.

To reform mask 92 into a standard collar 93, the above described process of folding panel 97 is merely reversed.

Accordingly, by providing a cuff construction in accordance with the invention, a hand, foot or head covering with a panel which switches from a first open position to a second closed position is provided. The panel may be a single ply or formed from a loop of material which may be provided with a closure for forming a pocket when in the open position. Use of a loop allows formation of a pocket in both the open or closed position. When the hand, foot or head covering is not in use, it is merely stored within the cuff itself.

It will thus be seen that the objects set forth above, among those made apparent from the preceding description, are efficiently attained and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A cuff construction for an article of clothing, comprising:

an opening formed at a neck portion in the article of clothing;

a cuff having an inner surface and an outer surface formed about the opening and having a distal end;

a panel having a distal end and two adjacent sides secured to the distal end of the cuff, the panel having a first side extending for at least a portion of the perimeter of the distal ends of the cuff at the opening forming a fold line and the first side of the panel secured to the cuff at the opening and the two adjacent sides of the panel secured to the cuff for forming a pocket access facing away from the opening to define a first open position, the panel adapted to be folded about a fold line from the first open position to a second closed position, the first open position allowing the head and neck of a wearer to pass through the opening in the article of clothing and in the second closed position the panel folded over the opening to form a covering for at least a portion of the wearer's head.

2. The cuff construction of claim 1, wherein the cuff when in the open position forms a neck and is formed further with eye holes adapted to align with the eyes of the wearer for viewing through the mask when the cuff construction is in the closed position and said eye holes covered by the panel in the pocket when the cuff is in the open position.

3. The cuff construction of claim 2, wherein the cuff further comprises a mouth opening aligning with the mouth of the wearer when the mask is worn.

4. The cuff construction of claim 2, wherein the cuff further comprises a nose opening, said nose opening aligning itself with the nose of the wearer when the mask is worn.

5. A cuff construction for an article of clothing, comprising:

an opening formed at a neck portion in the article of clothing;

a cuff formed about the opening and having a distal end; and a panel integrally formed at the distal end of the cuff extending around the perimeter of the distal end of the cuff to form a fold line, the panel adapted to be folded about the fold line from a first open position to a second closed position, the first open position allowing the head of a wearer to pass through the opening in the article of clothing, and in the second closed position the panel folded over the opening to form a covering for the wearer's head.

6. The cuff construction of claim 1, wherein the cuff is formed completely about the neck opening.

7. The cuff construction of claim 6, wherein the panel is formed about the portion of the cuff disposed in the front of the garment.

8. The cuff construction of claim 7, wherein the panel is formed with at least one opening for aligning with the eyes, nose and mouth when the panel is unfolded to its second position.

9. The cuff construction of claim 1, wherein the cuff and panel is integrally formed with the garment.

10. The cuff construction of claim 9, wherein the garment is formed of an resilient knit fabric.

* * * * *